US006475373B1

(12) United States Patent
Shimomura et al.

(10) Patent No.: US 6,475,373 B1
(45) Date of Patent: Nov. 5, 2002

(54) METHOD OF CONTROLLING $NO_X$ GAS EMISSION BY HYDROGEN PEROXIDE

(75) Inventors: Tadashi Shimomura, Chiba-ken; Masaru Ohto, Tokyo; Hiroya Watanabe, Chiba-ken, all of (JP)

(73) Assignee: Mitsubishi Gas Chemical Company, Inc., Tokyo (JP)

( * ) Notice: Subject to any disclaimer, the term of this patent is extended or adjusted under 35 U.S.C. 154(b) by 0 days.

(21) Appl. No.: 09/542,847

(22) Filed: Apr. 4, 2000

(30) Foreign Application Priority Data

Apr. 8, 1999 (JP) ..... 11-101676
Apr. 23, 1999 (JP) ..... 11-115834

(51) Int. Cl.[7] ..... G01N 27/26

(52) U.S. Cl. ..... 205/781; 204/400; 204/412; 205/775; 216/108; 216/109

(58) Field of Search ..... 205/775, 780.5, 205/781, 782; 216/108, 109

(56) References Cited

U.S. PATENT DOCUMENTS 3,795,589 A * 3/1974 Dahms
3,945,865 A 3/1976 Kamperman
4,913,780 A * 4/1990 Habermann et al.
4,938,838 A 7/1990 Dalin et al.
5,382,331 A * 1/1995 Banks
5,439,569 A * 8/1995 Carpio et al.
5,456,795 A * 10/1995 Danjo et al.
5,518,591 A * 5/1996 Pulliainen et al.
5,605,617 A * 2/1997 Bidan et al.
6,129,831 A * 10/2000 Temmerman et al.

FOREIGN PATENT DOCUMENTS

| | | |
|---|---|---|
| DE | 269916 | 7/1989 |
| EP | 0259533 | 3/1988 |
| EP | 0267166 | 5/1988 |
| FR | 2279447 | 2/1976 |
| GB | 2027004 | 2/1980 |
| JP | 48-37653 | 11/1973 |
| JP | 54-33160 | 10/1979 |
| JP | 55-134694 | 10/1980 |
| JP | 57-21658 | 5/1982 |

* cited by examiner

*Primary Examiner*—T. Tung
(74) *Attorney, Agent, or Firm*—Antonelli, Terry, Stout & Kraus, LLP

(57) ABSTRACT

Emission of NOx during acid-picldingtreatment of metals in an aqueous solution containing at least nitric acid is controlled by the addition of hydrogen peroxide. The addition amount of hydrogen peroxide is minimized to avoid excessive addition by monitoring the potentiostatic electrolytic current of the solution or by combinedly monitoring the potentiostatic electrolytic current and the redox potential of the solution.

8 Claims, 7 Drawing Sheets

METHOD OF CONTROLLING $NO_X$ GAS EMISSION BY HYDROGEN PEROXIDE

BACKGROUND OF THE INVENTION

The present invention relates to a method of controlling NOx gas emission during treatment of metals in nitric acid solutions by the addition of hydrogen peroxide to the solutions.

Nitric acid is finding wide applications in various industries. However, the pickling treatment of metals in nitric acid solutions generally involves the emission of NOx gas detrimental to the environment and human health. In acid-pickling of stainless steels in a mixed acid solution containing nitric acid and hydrofluoric acid, the dissolution of stainless steels results in the formation of nitrous acid in the mixed acid solution. The nitrous acid thus formed is converted to NO and $NO_2$ through various reactions in the solution, and finally evolved as NOx gas from the solution. Scrubbers or other devices have been used to prevent the discharge of NOx gas into the environment. However, the treatment of NOx gas by scrubber, etc. requires additional equipment cost and routine maintenance of apparatus for treating exhaust gas.

U.S. Pat. No. 3,945,865 proposes to control NOx gas emission by the addition of hydrogen peroxide to nitric acid solutions. However, the patent teaches nothing about means for controlling the addition amount of hydrogen peroxide within suitable range. An excess of hydrogen peroxide is readily decomposed in nitric-hydrofluoric acid systems due to metal ions therein to result in unnecessary waste of hydrogen peroxide. Japanese Patent Application Laid-Open No. 55-134694 proposes to control the addition amount of hydrogen peroxide based on the redox potential of nitrous acid solution. However, since the relationship between the redox potential and the nitrous acid concentration is variable, the addition amount of hydrogen peroxide cannot be controlled precisely.

SUMMARY OF THE INVENTION

Thus, an object of the present invention is to provide a method of effectively controlling the NOx gas emission from nitric acid solutions, thereby solving the above problems in the prior art.

As a result of extensive study on controlling the addition amount of hydrogen peroxide, the inventors have found that the electrolytic current during potentiostatic electrolysis of nitric acid solutions has a close quantitative relationship to the nitrite ion concentration in the solutions and the evolution amount of NOx gas, and that the addition of hydrogen peroxide is easily controlled by monitoring the electrolysis current, thereby minimizing the addition amount of hydrogen peroxide required for controlling NOx gas emission.

The inventors have further found that the NOx gas emission is effectively controlled by combinedly monitoring the potentiostatic electrolytic current and the redox potential, while avoiding excessive addition of hydrogen peroxide. The present invention has been accomplished based on these findings.

Thus, in a first aspect of the present invention, provided is a method of controlling NOx gas emission from a solution containing at least nitric acid, the addition amount of hydrogen peroxide to the solution is regulated depending on electrolytic current monitored during potentiostatic electrolysis of the solution.

DETAILED DESCRIPTION OF THE INVENTION

The present invention is suitably applied to a mixed acid system of nitric acid and hydrofluoric acid for use in pickling of stainless steels, and a nitric acid solution for use in surface treatment of copper, brass, etc. For example, since the pickling of stainless steels is performed in either batch-wise manner or continuous manner and the temperature of the mixed acid system, the dissolved amount of stainless steels, etc. change as the pickling treatment proceeds, the emission amount of NOx also varies with time. Therefore, the amount of hydrogen peroxide required for preventing NOx emission also varies with time.

The present invention is also applied to oxidation of NOx, which is absorbed into NOx absorbent comprising a nitric acid solution, to nitric acid by hydrogen peroxide. For example, NOx gas in combustion exhaust of fuels such as coal and oil or NOx gas exhausted from apparatus for nitrifying or oxidizing organic compounds is absorbed into NOx absorbent and the absorbed NOx is oxidized to nitric acid.

In the potentiostatic electrolysis employed in the present invention, an aqueous solution containing at least nitric acid is electrolyzed by keeping the cathode potential constant. For example, the electrolytic current of a solution containing nitric acid and hydrofluoric acid is sensed by a triode potentiostat equipped with a working electrode, a counter electrode and a reference electrode. The materials for the working and counter electrodes are required to be stable against the electrolytic solution and insoluble therein, and preferably platinum because the electrolytic solution contains nitric acid and optionally hydrofluoric acid. The material for the reference electrode is not specifically limited. However, since glass dissolves into an electrolytic solution containing hydrofluoric acid, a silver/silver chloride electrode with resin housing is preferable due to its easiness of handling. Also, preferred is a double junction type because the contamination of the electrolytic solution can be avoided.

The electrolytic solution, i.e., the pickling bath is an aqueous solution containing at least nitric acid (hereinafter may be referred to as "nitric acid solution"), preferably in a weight concentration of 5 to 15%. The aqueous solution may further contain hydrofluoric acid preferably in a weight concentration of 1 to 10%.

Figure 1:
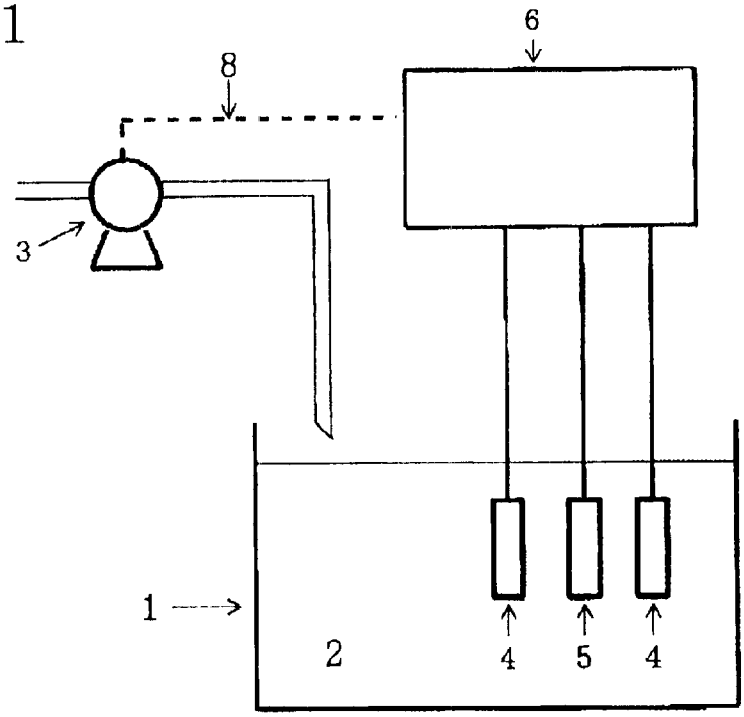
FIG. 1 is a schematic illustration showing an NOx controlling apparatus equipped with a triode potentiostat.
Figure 2:
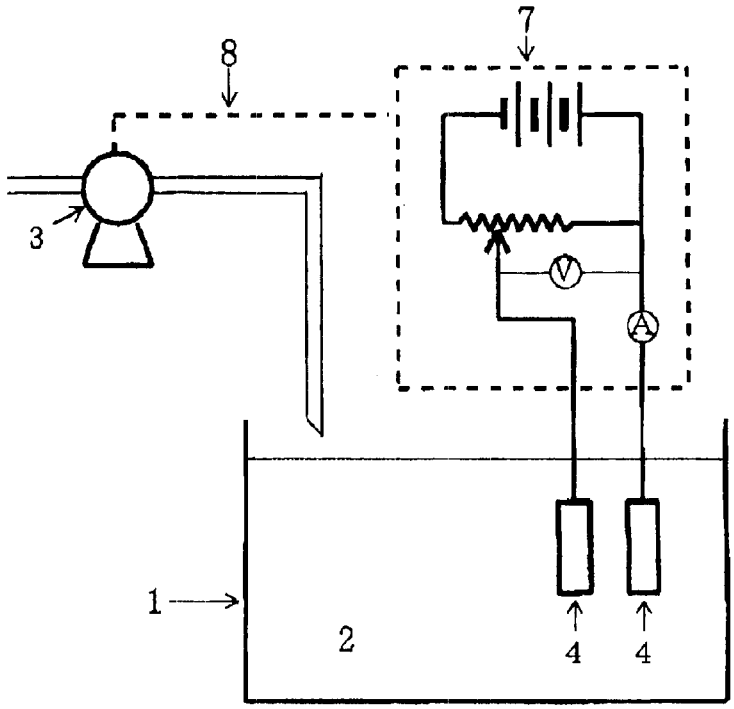
FIG. 2 is a schematic illustration showing an NOx controlling apparatus equipped with a diode potentiostat.

The same relationship of the electrolytic current to the nitrite ion concentration and the NOx gas emission amount, as obtained by triode potentiostat, is also obtained by a diode potentiostat equipped with a platinum working electrode and a platinum counter electrode while keeping the potential between the electrodes constant. Schematic illustrations of apparatuses usable in the first NOx controlling method are shown in FIGS. 1 and 2. In FIG. 1, a pickling bath 2, i.e., a nitric acid solution in a pickling vessel 1 is potentiostatically electrolyzed using a triode potentiostat 6 equipped with a triode potentiostat 6 having working and counter electrodes 4, 4 and a reference electrode 5. As will be described below, a pump 3 for supplying hydrogen peroxide is driven and controlled by a control signal 8 from the triode potentiostat 6 so as to start the addition of hydrogen peroxide if the electrolytic current sensed by the triode potentiostat 6 is larger than a maximum allowable limit which is set in advance according to the intended tolerable limit of NOx emission until the electrolytic current is reduced to lower than the maximum allowable limit. In an NOx controlling apparatus of FIG. 2, a diode potentiostat 7 having working and counter electrodes 4, 4 is used in place of the triode potentiostat 6. In the accompanying drawings, like reference numerals indicate like parts.

The surface area of each electrode is not strictly limited. However, since the amount of sensed current is influenced by the surface area, it is determined depending on required current intensity. To control the emission amount of NOx within intended levels, an amount of hydrogen peroxide to react with nitrite ion is preferred to be automatically supplied to the electrolytic solution depending on the sensed electrolytic current value. In this case, each electrode is required to have enough surface area to gain electrolytic current sufficient for controlling an automatic supplier of hydrogen peroxide. Inter-electrode space and electrolytic temperature are preferably kept constant so as to sense stable electrolytic current value. Inter-electrode space of about 2 to 8 cm is preferable for practical use.

Figure 3:
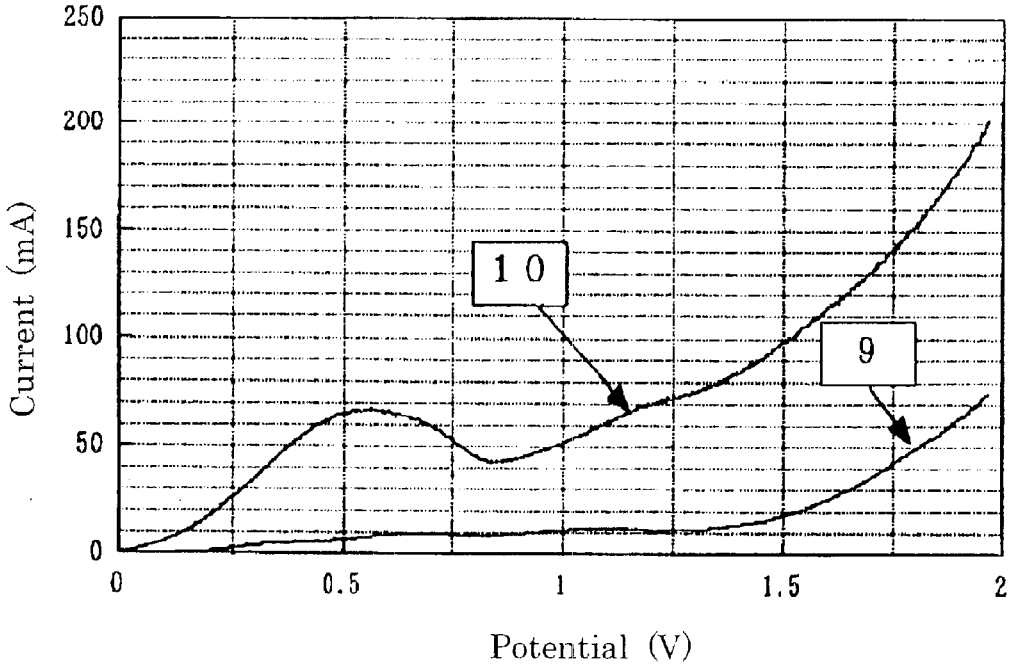
FIG. 3 is a graph showing the relationship between the potential and the electrolytic current of an acid pickle measured by a diode potentiostat.

FIG. 3 is a graph showing a relationship between the potential and the electrolytic current of an acid pickle measured by a diode potentiostat. A nitric-hydrofluoric acid pickle usually used for pickling stainless steels was used. The nitrite ion concentration was measured by ion chromatograph. The measuring conditions are shown below.

Acid Pickle: Aqueous solution of 10% by weight of nitric acid and 4% by weight of hydrofluoric acid.

Electrolytic Temperature: 40° C. (under stirring).

Working and Counter Electrodes: Platinum wire (surface area: 4.7 $cm^2$).

Inter-Electrode Space: 4 cm.

Amount of Pickle: 400 ml.

Upon comparing the potential-current curve 9 immediately after preparing the pickling bath and the potential-current curve 10 after immersing stainless steel (SUS430) thereinto, it can be seen that the current value after immersion of stainless steel was always larger than before immersion. The nitrite ion concentration of the pickling bath after immersion was 0.55 g/liter. Also, the current value before immersion was kept nearly constant to about 10 mA at a potential range between 0.20 to 1.25 V.

Figure 4:
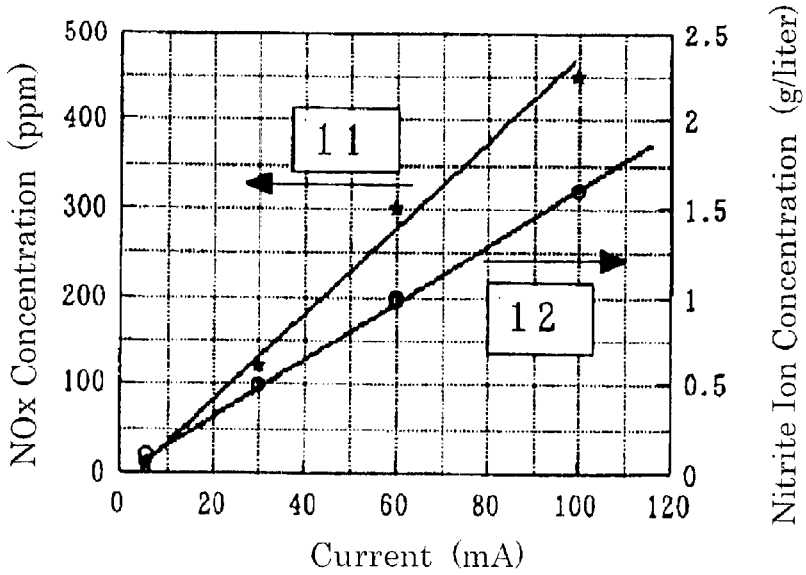
FIG. 4 is a graph showing the relationship of the electrolytic current to the nitrite ion concentration and the NOx gas concentration at an electrolytic potential of 0.5 V.

The above procedures were repeated potentiostatically at an electrolytic potential of 0.5 V. FIG. 4 is a graph showing a relationship 11 between the electrolytic current and the NOx gas concentration on the surface of the pickle measured by a gas detector tube and a relationship 12 between the electrolytic current and the nitrite ion concentration measured by ion chromatograph. It would appear that the emission amount of NOx gas is proportional to the electrolytic current. With this proportional relationship, the emission amount of NOx gas is controlled by adding hydrogen peroxide so as to keep the electrolytic current equal to or lower than a maximum allowable limit determined depending upon tolerable NOx emission levels.

In the first NOx controlling method, the maximum allowable limit of the electrolytic current is suitably determined depending on the tolerable limit of NOx concentration of the atmosphere on the surface of pickling solution. The determination could be made easily from an electrolytic current-NOx concentration curve as shown in FIG. 4. For example, when the NOx concentration is to be controlled to 80 ppm or less at an electrolytic potential of 0.5 V, FIG. 4 shows that hydrogen peroxide should be added so as to keep the electrolytic current at 20 mA or lower. The addition of hydrogen peroxide is usually stopped immediately after the electrolytic current is reduced to the maximum allowable limit or lower, thereby avoiding excessive addition. In this manner, the emission amount of NOx gas is kept equal to or lower than intended levels depending on the maximum allowable limit of electrolytic current to be set. Although the maximum allowable limit of electrolytic current to be set varies depending on intended limit of NOx emission, electrolytic potential and other factors familiar to those skilled in the art, the maximum allowable limit is preferably set to 2 to 10 mA at a pickling temperature of 20 to 60° C. Hydrogen peroxide may be supplied using a simple on-off control.

Next, the second NOx controlling method will be described. It should be noted that the description on the first method is applicable equally to the second method as far as the features commonly included in both the methods are concerned.

The material of the measuring electrode for measuring the redox potential in the second NOx controlling method is not strictly limited as far as the material is inert to the nitric acid solution. For example, when the nitric acid solution further contains hydrofluoric acid, a platinum electrode is preferable as the measuring electrode and a double junction silver/silver chloride electrode with a resin housing is preferable as a reference electrode. The potentiostatic electrolytic current is measured in the same manner as in the first NOx controlling method.

Figure 6:
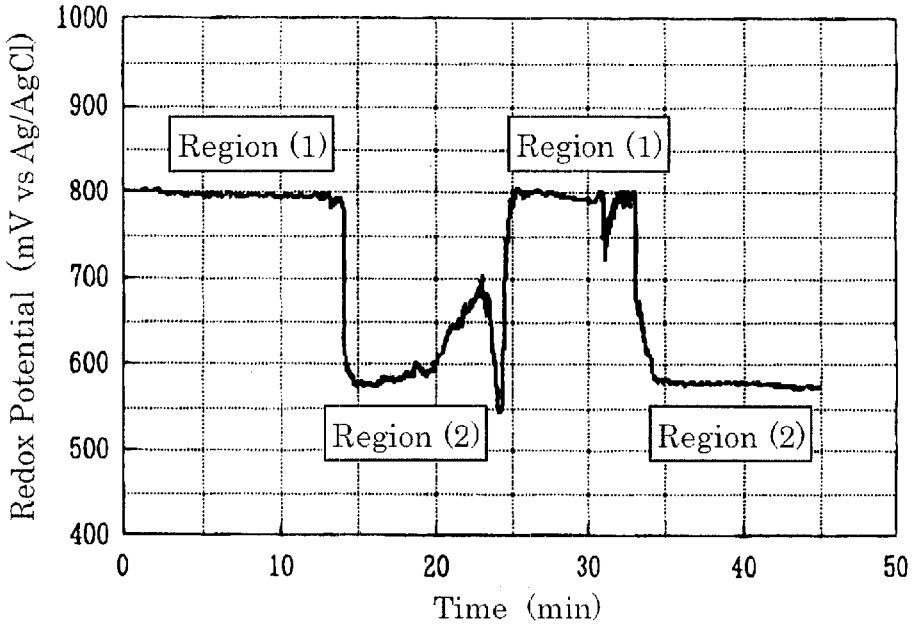
FIG. 6 is a graph showing the change of the redox potential with the addition of hydrogen peroxide.

FIG. 6 is a graph showing the change of redox potential when hydrogen peroxide was intermittently added to a solution containing nitric acid and hydrofluoric acid while dissolving stainless steel (SUS430) therein. The higher potential region (1) shows the presence of nitrite ion (deficiency of hydrogen peroxide) and the lower potential region (2) shows the presence of hydrogen peroxide (excess of hydrogen peroxide). Although the absolute value of redox potential varies depending on materials of electrodes, temperature of the solution, acid and metal concentrations in the solution, etc., the potential difference between the nitrite ion-existing state (deficiency of hydrogen peroxide) and the hydrogen peroxide-excessive state is about 200 mV Therefore, by monitoring the potential difference, the presence of excessive hydrogen peroxide is sensed. In the present invention, the redox potential is set to a level at which hydrogen peroxide is not present excessively, preferably about 625 to 775 mV, more preferably about 700 mV vs. Ag/AgCl reference electrode.

Figure 7:
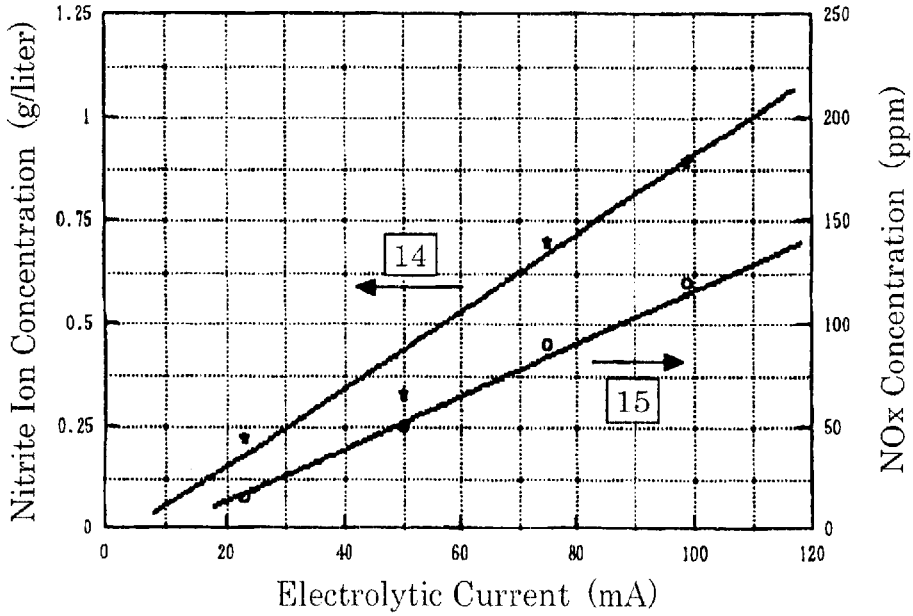
FIG. 7 is a graph showing the relationship of the electrolytic current to the nitrite ion concentration and the NOx gas concentration.

FIG. 7 is a graph showing a relationship 14 between the potentiostatic electrolytic current and the nitrite ion concentration of an acid pickle, and a relationship 15 of the potentiostatic electrolytic current and the NOx gas concentration on the surface of the pickle. The concentration of nitrite ion was measured by an ion chromatograph, and the NOx concentration was measured by a gas detector tube. A nitric-hydrofluoric acid pickle usually used for pickling stainless steels was used. The measuring conditions are shown below.

Acid Pickle: Aqueous solution of 10% by weight of nitric acid and 4% by weight of hydrofluoric acid.

Electrolytic Temperature: 40° C. (under stirring).

Electrolytic Potential: 1.1 V.

Working and Counter Electrodes: platinum wire (surface area: 4.7 $cm^2$).

Reference Electrode: copper/silver chloride (double junction).

Inter-Electrode Space: 4 cm.

Amount of Pickle: 500 ml.

As seen from FIG. 7, it would appear that the potentiostatic electrolytic current is proportional to both the nitrite ion concentration (curve 14) and the NOx gas concentration (curve 15). With this proportional relationship, the addition amount of hydrogen peroxide for controlling the NOx gas emission is regulated based on the values of potentiostatic electrolytic current. Like the first NOx controlling method, the maximum allowable limit of the potentiostatic electrolytic current is suitably determined based on the tolerable limit of NOx concentration. The determination could be made easily from an electrolytic current-NOx gas concentration curve as shown in FIG. 7. For example, when the NOx concentration is to be controlled to 20 ppm or less, FIG. 7 shows that hydrogen peroxide should be added when the electrolytic current exceeds 20 mA. In this manner, the emission amount of NOx gas is kept lower than the tolerable limit according to the maximum allowable limit of potentiostatic electrolytic current to be set.

Figure 8:
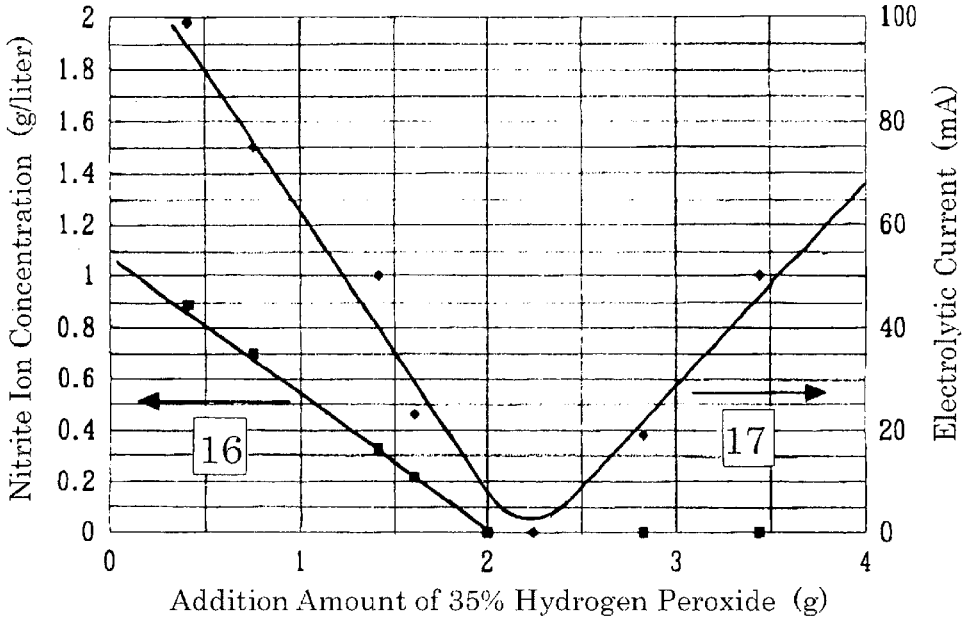
FIG. 8 is a graph showing the relationship of the addition amount of hydrogen peroxide to the nitrite ion concentration and the electrolytic current.

As shown by a curve 16 in FIG. 8, the nitrite ion concentration decreases and finally reaches zero as the addition of hydrogen peroxide is continued. Then, hydrogen peroxide comes to exist excessively, this in turn increasing the electrolytic current in proportion to the amount of hydrogen peroxide as shown by a curve 17. Therefore, it is necessary to determine whether the sensed electrolytic current is attributable to nitrite ion or hydrogen peroxide.

In the second NOx controlling method, the addition of hydrogen peroxide is controlled by combining the relationships shown in FIGS. 6 and 7, thereby making the nitrite ion concentration as low as possible while avoiding excessive addition of hydrogen peroxide. Namely, the addition of hydrogen peroxide is started when both the potentiostatic electrolytic current and the redox potential simultaneously exceed respective maximum allowable limits and continued until both the current and potential are reduced to the maximum allowable limits or lower, thereby controlling the NOx gas emission to lower than a tolerable limit and preventing hydrogen peroxide from being added excessively. The addition of hydrogen peroxide is regulated by on-off control.

The second NOx controlling method also provides a method of keeping the concentration of hydrogen peroxide in a nitric acid solution constant. Namely, by adding hydrogen peroxide when the redox potential is higher than the maximum allowable limit or the potentiostatic electrolytic current is lower than the maximum allowable limit, a pickling solution reaches a state of containing a slightly excessive hydrogen peroxide at a constant level and substantially no nitrite ion. As described above with respect to FIG. 6, the region (1) where the redox potential is higher than the maximum allowable limit shows the presence of nitrite ion in the absence of hydrogen peroxide. Therefore, hydrogen peroxide is added when the redox potential exceeds the maximum allowable limit, thereby reducing the nitrite ion concentration. Although the redox potential becomes lower than the maximum allowable limit when the nitrite ion concentration reaches zero and hydrogen peroxide comes to remain not consumed, the electrolytic current changes to increase in proportion to the amount of hydrogen peroxide as shown in FIG. 8. Therefore, the addition of hydrogen peroxide is stopped when the redox potential is reduced to the maximum allowable limit or lower and the potentiostatic electrolytic current is increased to the maximum allowable limit or higher. The maximum allowable limit of potentiostatic electrolytic current is preferably 1 to 100 mA and is determined from a hydrogen peroxide amount-electrolytic current curve as shown in FIG. 8 according to the allowable amount of remaining hydrogen peroxide. With such a controlled addition, the hydrogen peroxide concentration in the nitric acid solution is kept constant during prickling treatment.

The present invention will be explained in more detail by reference to the following example which should not be construed to limit the scope of the present invention thereto.

EXAMPLE 1

Figure 5:
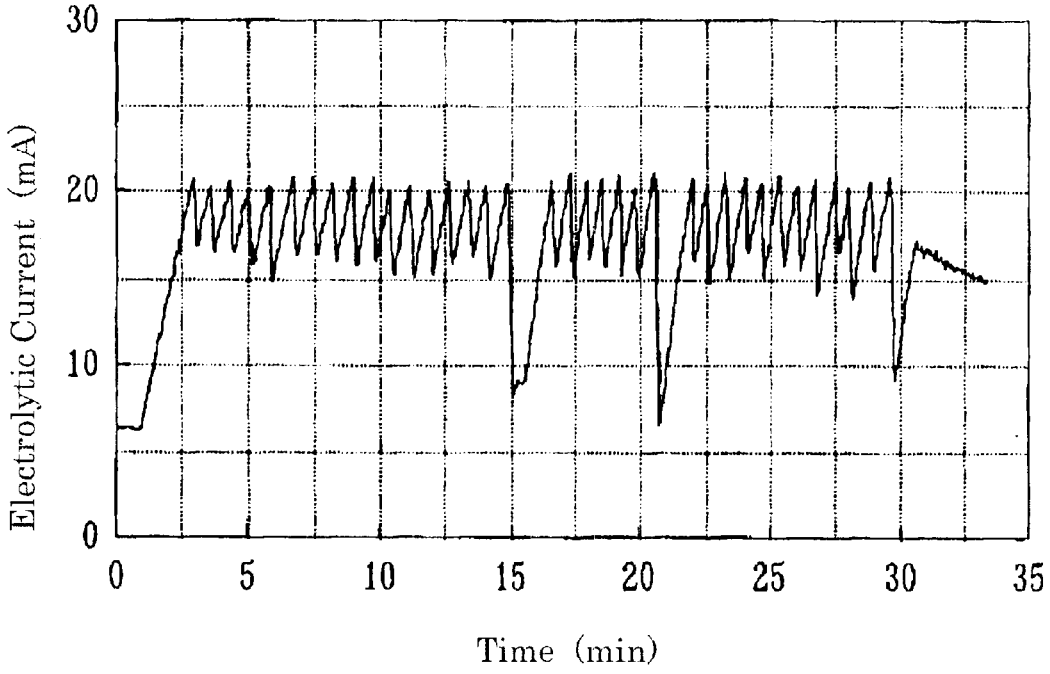
FIG. 5 is a graph showing the change with time of the electrolytic current measured in Example 1.

Using an NOx controlling device equipped with diode potentiostat as shown in FIG. 2, SUS430(3×5 cm plate) was immersed and dissolved at 40° C. into 1 liter of an aqueous acid pickle containing 10% by weight of nitric acid and 4% by weight of hydrofluoric acid. The electrolytic potential was set at 0.5 V. The supply of hydrogen peroxide was controlled so that the addition was started when the electrolytic current exceeded 20 mA and stopped immediately after reduced to 20 mA or lower. The change of the electrolytic current with the addition of hydrogen peroxide is shown in FIG. 5. During the measurement, the NOx gas concentration on the surface of pickle was always about 80 ppm or lower.

EXAMPLE 2

The same procedures as in Example 1 were repeated except that the supply of hydrogen peroxide was controlled so that the addition was started when the electrolytic current exceeded 5 mA and stopped immediately after reduced to 5 mA or lower. During the measurement, the NOx gas concentration on the surface of pickle was always about 10 ppm or lower.

EXAMPLE 3

Using an NOx controlling device equipped with triode potentiostat as shown in FIG. 1 having a double junction silver/silver chloride reference electrode, SUS430 (3×5 cm plate) was immersed and dissolved at 40° C. into 1 liter of an aqueous acid pickle containing 10% by weight of nitric acid and 4% by weight of hydrofluoric acid. The electrolytic potential was set at 1.1 V vs. the Ag/AgCl reference electrode, and the supply of hydrogen peroxide was controlled so that the addition was started when the electrolytic current exceeded 20 mA and stopped immediately after reduced to 20 mA or lower. During the measurement, the NOx gas concentration on the surface of pickle was always about 70 ppm or lower.

EXAMPLE 4

Figure 9:
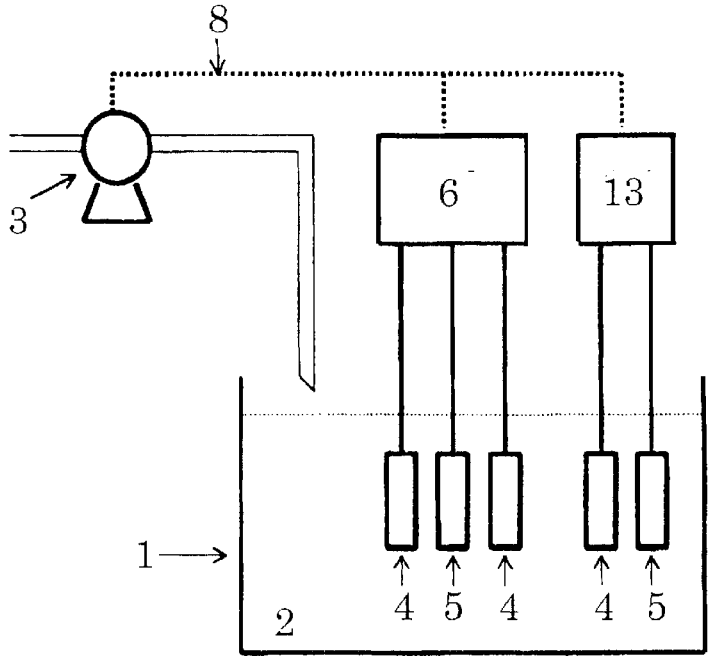
FIG. 9 is a schematic illustration showing an NOx controlling apparatus equipped with a redox potentiometer and a triode potentiostat.
Figure 11:
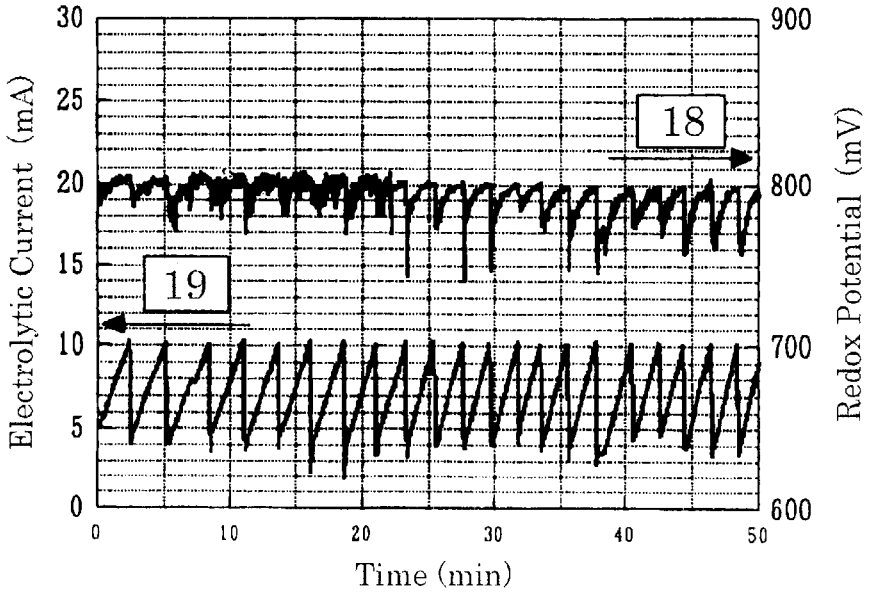
FIG. 11 is a graph showing the changes of the electrolytic current and the redox potential of Example 4.

Using an NOx controlling apparatus as shown in FIG. 9, SUS430(3×5 cm plate) was immersed and dissolved at 40 ° C. into 1 liter of an aqueous acid pickle containing 10% by weight of nitric acid and 4% by weight of hydrofluoric acid. As shown in FIG. 9, the NOx controlling apparatus was equipped with a redox potentiometer 13 having a platinum measuring electrode 4 and a reference electrode 5 in addition to a triode potentiostat 6 having working and counter electrodes 4, 4 and a reference electrode 5. The pump for supplying hydrogen peroxide was controlled by control signal 8 from the triode potentiostat 6 and the redox potentiometer 13. The addition of hydrogen peroxide was controlled so that the addition was started when the redox potential exceeded 700 mV, and simultaneously, the electrolytic current exceeded 10 mA at a constant electrolytic potential of 1.1 V. The addition was stopped when the electrolytic current was reduced to 10 mA or lower. The changes of the redox potential 18 and the electrolytic current 19 with the addition of hydrogen peroxide are shown in FIG. 11. During the measurement, the NOx gas concentration on the surface of pickle was always about 10 ppm or lower.

EXAMPLE 5

Figure 10:
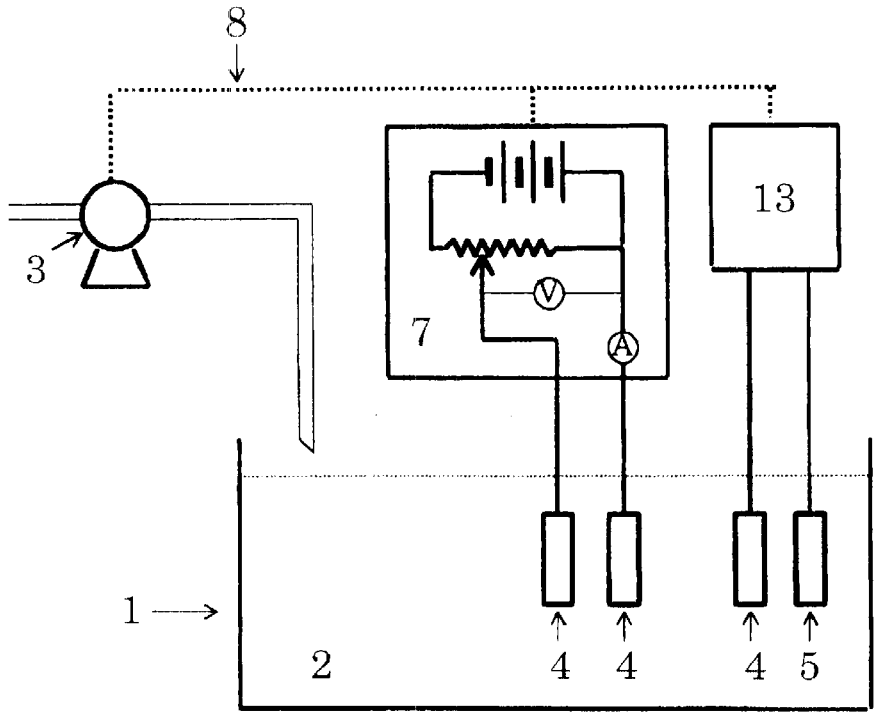
FIG. 10 is a schematic illustration showing an NOx controlling apparatus equipped with a redox potentiometer and a diode potentiostat.
Figure 12:
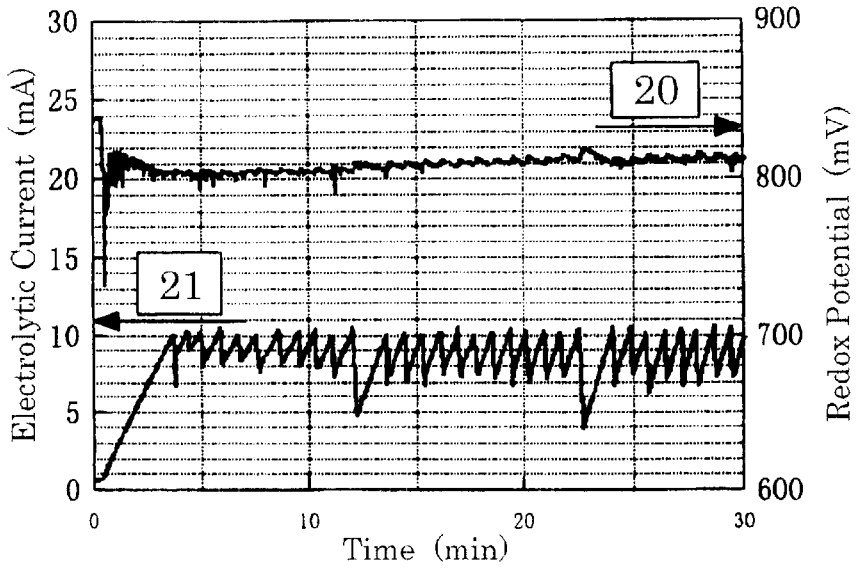
FIG. 12 is a graph showing the changes of the electrolytic current and the redox potential of Example 5.

Using an NOx controlling apparatus as shown in FIG. 10, SUS430(3×5 cm plate) was immersed and dissolved at 50° C. into 500 ml of an aqueous acid pickle containing 10% by weight of nitric acid and 4% by weight of hydrofluoric acid. As shown in FIG. 10, the NOx controlling apparatus was equipped with a redox potentiometer 13 having a platinum measuring electrode 4 and a reference electrode 5 in addition to a diode potentiostat 7 having working and counter electrodes 4, 4. The pump 3 for supplying hydrogen peroxide was controlled by control signal 8 from the diode potentiostat 7 and the redox potentiometer 13. The addition of hydrogen peroxide was controlled so that the addition was started when the redox potential exceeded 750 mV, and simultaneously, the electrolytic current exceeded 10 mA at a constant electrolytic potential of 0.5 V The addition was stopped when the electrolytic current was reduced to 10 mA or lower. The changes of the redox potential 20 and the electrolytic current 21 with the addition of hydrogen peroxide are shown in FIG. 12. During the measurement, the NOx gas concentration on the surface of pickle was always about 40 ppm or lower.

EXAMPLE 6

Figure 13:
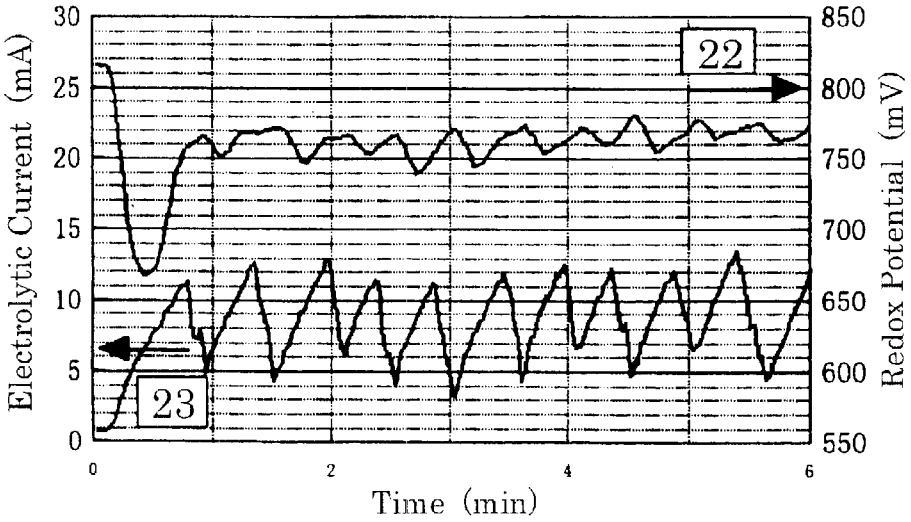
FIG. 13 is a graph showing the changes of the electrolytic current and the redox potential of Example 6.

Using an NOx controlling apparatus equipped with diode potentiostat as shown in FIG. 10, SPCC steel (4×6 cm plate) was immersed and dissolved at 50° C. into 500 ml of an aqueous acid pickle containing 10% by weight of nitric acid. The addition of hydrogen peroxide was controlled so that the addition was started when the redox potential exceeded 720 mV, and simultaneously, the electrolytic current exceeded 10 mA at a constant electrolytic potential of 0.7 V. The addition was stopped when the electrolytic current was reduced to 10 mA or lower. The changes of the redox potential 22 and the electrolytic current 23 with the addition of hydrogen peroxide are shown in FIG. 13. During the measurement, the NOx gas concentration on the surface of pickle was always about 10 ppm or lower.

EXAMPLE 7

Using an NOx controlling apparatus equipped with a diode potentiostat as shown in FIG. 10, SUS430(3×5 cm plate) was immersed and dissolved at 40 ° C. into 500 ml of an aqueous acid pickle containing 10% by weight of nitric acid and 4% by weight of hydlofluoric acid. The addition of hydrogen peroxide was controlled so that the addition was started when the redox potential exceeded 700 mV or the electrolytic current was lower than 5 mA at a constant electrolytic potential of 0.5 V, and stopped when the redox potential was reduced to 700 mV or lower and the electrolytic current reached 5 mA or higher. During the measurement, the NOx gas concentration on the surface of pickle was substantially zero (lower than the detection limit of NOx detection tube), and the hydrogen peroxide concentration was kept at about 0.05% by weight.

COMPARATIVE EXAMPLE 1

Without adding hydrogen peroxide, SUS430(3×5 cm plate) was immersed and dissolved at 40 ° C. into 1 liter of an aqueous acid pickle containing 10% by weight of nitric acid and 4% by weight of hydrofluoric acid. During the measurement, the NOx gas concentration on the surface of pickle continuously increased with treatment of stainless steel and reached a maximum of 1000 ppm.

What is claimed is:

1. A method of controlling NOx gas emission from a solution containing at least nitric acid, comprising:

determining a maximum allowable limit of a potentiostatic electrolytic current from a NOx gas concentration-electrolytic current curve so as to control NOx gas concentration of a surface of the solution to an intended tolerable level or lower, then starting the addition of hydrogen peroxide to the solution when the potentiostatic electrolytic current exceeds the maximum allowable limit, and stopping the addition of hydrogen peroxide to the solution when the potentiostatic electrolytic current is reduced to the maximum allowable limit or lower.

2. The method according to claim 1, wherein the electrolytic current is sensed by a potentiostat, and the start and stop of the addition of hydrogen peroxide are switched by control signals generated by comparing the sensed electrolytic current with the maximum allowable limit.

3. The method according to claim 1, wherein the solution further contains hydrofluoric acid.

4. A method of controlling NOx gas emission from a solution containing at least nitric acid, comprising:

determining a maximum allowable limit of a potentiostatic electrolytic current from a NOx gas concentration-electrolytic current curve so as to control NOx gas concentration of a surface of said solution to an intended tolerable level or lower, setting a maximum allowable limit of a redox potential of the solution to a potential at which hydrogen peroxide is not present in excess, and then adding hydrogen peroxide when both the redox potential and the potentiostatic electrolytic current exceed respective maximum allowable limits.

5. The method according to claim 4, further comprising sensing the electrolytic current by a potentiostat and sensing the redox potential by a redox potentiometer, and wherein start and stop of the adding of hydrogen peroxide are switched by control signals generated by comparing the sensed electrolytic current with the maximum allowable limit thereof and comparing the sensed redox potential with the maximum allowable limit thereof.

6. The method according to claim 4, wherein the solution further contains hydrofluoric acid.

7. A method of controlling NOx gas emission from a solution containing at least nitric acid, comprising:

determining a maximum allowable limit of a potentiostatic electrolytic current from a hydrogen peroxide concentration-electrolytic current curve when hydrogen peroxide is added to the solution containing at least nitric acid so as to control the range of the hydrogen peroxide concentration to an intended level, setting a maximum allowable limit of a redox potential of the solution to a level at which hydrogen peroxide is not present in excess, then starting addition of hydrogen peroxide when the redox potential exceeds a maximum allowable limit thereof or the potentiostatic electrolytic current is lower than a maximum allowable limit thereof at lower hydrogen peroxide concentration, and stopping the addition when the redox potential becomes lower than the maximum allowable limit thereof and the potentiostatic electrolytic current exceeds the maximum allowable limit thereof at higher hydrogen peroxide concentration.

8. The method according to claim 7, further comprising sensing the electrolytic current by a potentiostat and sensing the redox potential by a redox potentiometer, and wherein start and stop of the addition of hydrogen peroxide are switched by control signals generated by comparing the sensed electrolytic current with the maximum allowable limit thereof and comparing the sensed redox potential with the maximum allowable limit thereof.

* * * * *